US005723829A

United States Patent [19]

Inomata et al.

[11] Patent Number: 5,723,829

[45] Date of Patent: Mar. 3, 1998

[54] MUFFLER ASSEMBLY OF INTERNAL COMBUSTION ENGINE

[75] Inventors: Tomohisa Inomata, Kawasaki; Tohru Awaya; Koji Seki, both of Yokohama; Yukio Nakanishi; Tanomo Norikawa, both of Yokosuka, all of Japan

[73] Assignee: Calsonic Corporation, Tokyo, Japan

[21] Appl. No.: 571,773

[22] Filed: Dec. 13, 1995

[30] Foreign Application Priority Data

| | | | |
|---|---|---|---|
| Feb. 24, 1995 | [JP] | Japan | 7-036514 |
| Feb. 24, 1995 | [JP] | Japan | 7-036516 |
| Feb. 24, 1995 | [JP] | Japan | 7-036517 |

[51] Int. Cl.[6] ..... F01N 1/00

[52] U.S. Cl. ..... 181/254; 60/312

[58] Field of Search ..... 181/228, 236, 181/237, 239, 254, 255, 265, 269; 60/312; 137/861, 877, 513.3, 513.5, 560

[56] References Cited

U.S. PATENT DOCUMENTS

| | | | |
|---|---|---|---|
| 2,214,894 | 9/1940 | Wilson . | |
| 3,620,330 | 11/1971 | Hall | 181/254 |
| 4,866,933 | 9/1989 | Kao | 60/312 |
| 4,901,528 | 2/1990 | Saigo et al. | 60/312 |
| 4,913,260 | 4/1990 | Fallon | 181/254 |
| 4,971,166 | 11/1990 | Hase | 181/254 |

FOREIGN PATENT DOCUMENTS

| | | |
|---|---|---|
| 94 13 493.6 | 9/1940 | Germany . |
| 2 110 000 | 11/1972 | Germany . |
| 2-259217 | 10/1990 | Japan . |
| 3-185209 | 8/1991 | Japan . |
| 4-124418 | 4/1992 | Japan . |
| 5-86834 | 4/1993 | Japan . |

*Primary Examiner*—Khanh Dang
*Attorney, Agent, or Firm*—Foley & Lardner

[57] ABSTRACT

A muffler assembly, for an exhaust system of an internal combustion engine has an exhaust gas inlet tube projected into the muffler to feed the muffler with the exhaust gas of the engine. First and second flow passages are defined through which the exhaust gas from the muffler flows independently before discharged to the open air. The controller has a pneumatic actuator that has a piston rod and a work chamber. The piston rod is adapted to reciprocate linearly in accordance with the magnitude of pressure developed in the work chamber. The pressure of the exhaust gas of the engine is fed to the work chamber of the pneumatic actuator. The actuator controls a valve assembly which includes a valve plate and a pivot shaft through which the valve plate is pivotally installed in the second flow passage of the first means. A link mechanism is used to operatively connect the piston rod of the actuator to the pivot shaft of the valve assembly so that the movement of the piston rod induces an opening/closing pivoting of the valve plate in the second flow passage.

20 Claims, 14 Drawing Sheets

MUFFLER ASSEMBLY OF INTERNAL COMBUSTION ENGINE

BACKGROUND OF THE INVENTION

1. Field of the Invention

The present invention relates in general to exhaust systems of an automotive internal combustion engine and more particularly to the exhaust systems of a controllable type, including a muffler for muffling engine with muffler controller for controlling the performance of the muffler to control the pressure and sound of the exhaust gas. More specifically, the present invention is related to the muffler controllers of a type using a valve that varies the flow passage area of a gas flow path extending from the muffler.

2. Description of the Prior Art

For muffling the exhaust gas emitted from an automotive internal combustion engine, various types of exhaust systems have been proposed and put into practical use. Some of them are of a controllable type that includes a muffler for muffling the exhaust gas and a muffler controller for controlling the performance of the muffler. Some of the muffler controllers are of a type that includes a valve for opening and closing a certain exhaust passage defined in the muffler and an actuator for actuating the valve. These muffler controllers are shown in Japanese Patent First Provisional Publications Nos. 3-185209, 4-124418 and 2-259217.

However, due to inherent construction, the muffler controllers of these publications have failed to exhibit a satisfactory performance in optimally controlling the muffler. Furthermore, some are costly due to their complicated construction and costly parts employed therein.

SUMMARY OF THE INVENTION

It is therefore an object of the present invention to provide a muffler assembly having a controller that is free of the above-mentioned drawbacks.

According to the present invention, there is provided an improved muffler controller. The muffler controller comprises an actuator powered by the pressure developed in a muffler or an exhaust gas inlet tube extending from the engine to the muffler and a valve assembly that continuously varies the flow passage area of a certain exhaust gas outlet tube extending from the muffler in accordance with operation of the actuator.

According to a first aspect of the present invention, there is provided a muffler assembly for an exhaust system of an internal combustion engine. The muffler assembly comprises a muffler an exhaust gas inlet tube projecting into the muffler to feed the muffler with the exhaust gas of the engine; first means defining first and second flow passages through which the exhaust gas from the muffler flows independently before being discharged to the open air; a pneumatic actuator having a piston rod and a work chamber the piston rod being adapted to reciprocate in accordance with the magnitude of pressure developed in the work chamber; second means for feeding the pressure of the exhaust gas of the engine to the work chamber of the pneumatic actuator; a valve assembly including a valve plate, a pivot shaft through which the valve plate is pivotally installed in the second flow passage of the first means; and a link mechanism operatively connecting the piston rod of the actuator with the pivot shaft of the valve assembly, so that the movement of the piston rod induces an opening/closing pivoting of the valve plate in the second flow passage.

According to a second aspect of the present invention, there is provided a muffler assembly for an exhaust system of an internal combustion engine, which muffler assembly comprises a muffler; an exhaust gas inlet tube having a downstream portion projecting into the muffler to feed the muffler with the exhaust gas of the engine; first and second exhaust gas outlet tubes through which the exhaust gas from the muffler flows independently before being discharged to the open air; a pneumatic actuator having a piston rod and a work chamber, the piston rod being adapted to reciprocate in accordance with the magnitude of pressure developed in the work chamber; a pressure induction pipe for feeding the pressure of the exhaust gas in the muffler to the work chamber of the actuator, the pressure induction pipe having a tapered open end directed upstream toward an open end of the downstream portion of the exhaust gas inlet tube; a valve assembly including a valve plate, and a pivot shaft through which the valve plate is pivotally installed in the second exhaust gas outlet tube; a link having one end secured to the pivot shaft and the other end formed with a longitudinally extending elongated opening; and a pin secured to the piston rod and slidably engaged with the elongated opening of the link.

According to a third aspect of the present invention, there is provided a muffler assembly for an exhaust system of an internal combustion engine, which muffler assembly comprises a muffler; an exhaust gas inlet tube having a downstream portion projecting into the muffler to feed the muffler with the exhaust gas of the engine; first and second exhaust gas outlet tubes through which the exhaust gas from the muffler flows independently before being discharged to the open air; a pneumatic actuator having a piston rod and a work chamber, the piston rod being adapted to reciprocate linearly in accordance with the magnitude of pressure developed in the work chamber; a pressure induction pipe for feeding the pressure of the exhaust gas in the exhaust gas inlet tube to the work chamber of the actuator, the pressure induction pipe having a tapered open end directed upstream against the flow of exhaust gas flowing in the exhaust gas inlet tube; an orifice member operatively installed in the pressure induction pipe; a valve assembly including a valve plate and a pivot shaft through which the valve plate is pivotally installed in the second exhaust gas outlet tube; a link having one end secured to the pivot shaft and the other end formed with a longitudinally extending elongated opening; and a pin secured to the piston rod and slidably engaged with the elongated opening of the link.

According to a fourth aspect of the present invention, there is provided a muffler assembly for an exhaust system of an internal combustion engine, which muffler assembly comprises a muffler; an exhaust gas inlet tube having a downstream portion projecting into the muffler to feed the muffler with the exhaust gas of the engine; first and second exhaust gas outlet tubes through which the exhaust gas from the muffler flows independently before being discharged to the open air; a pneumatic actuator having a piston rod and a work chamber, the piston rod being adapted to reciprocate linearly in accordance with the magnitude of pressure developed in the work chamber; a pressure induction pipe for feeding the pressure of the exhaust gas in the muffler to the work chamber of the actuator, the pressure induction pipe having a tapered open end directed upstream toward an open end of the downstream portion of the exhaust gas inlet tube; a valve assembly including a valve plate, a pivot shaft through which the valve plate is pivotally installed in the second exhaust gas outlet tube; a first link having one end secured to the pivot shaft of the valve plate; a second link having one end pivotally connected to the other end of the first link; a fork-like end portion formed on the piston rod, the fork-like end portion having the other end of the second link pivotally connected thereto; a pivot pin through which the fork-link end portion and the other end of the second link is pivotally connected; and a holding pawl for holding the pivot pin in place.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In order to clarify the present invention, a controllable exhaust system of an internal combustion engine, to which a muffler controller of the invention is practically applied, will be briefly described with reference to the drawings.

Figure 1:
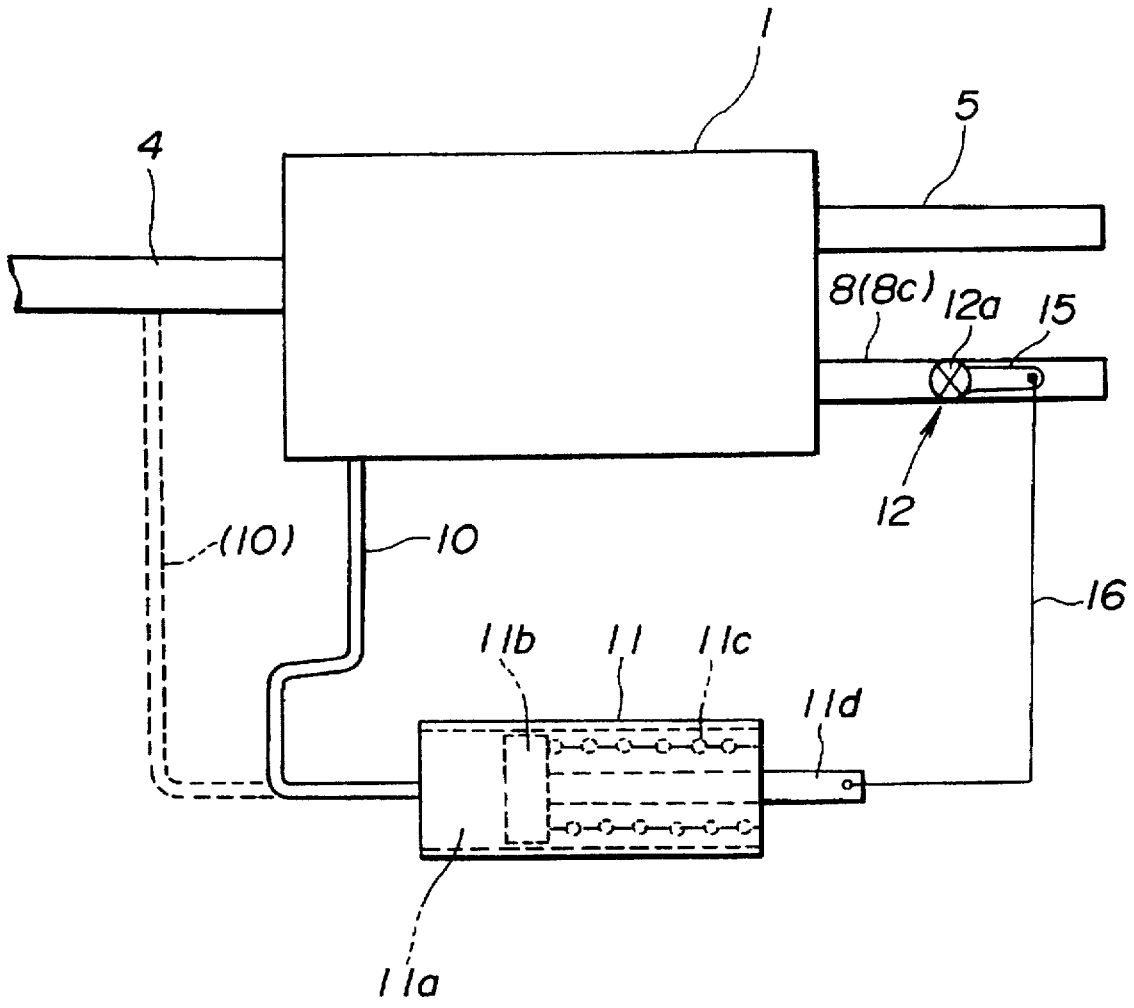
FIG. 1 is a schematic view of a muffler controller of a first embodiment of the present invention.
Figure 2:
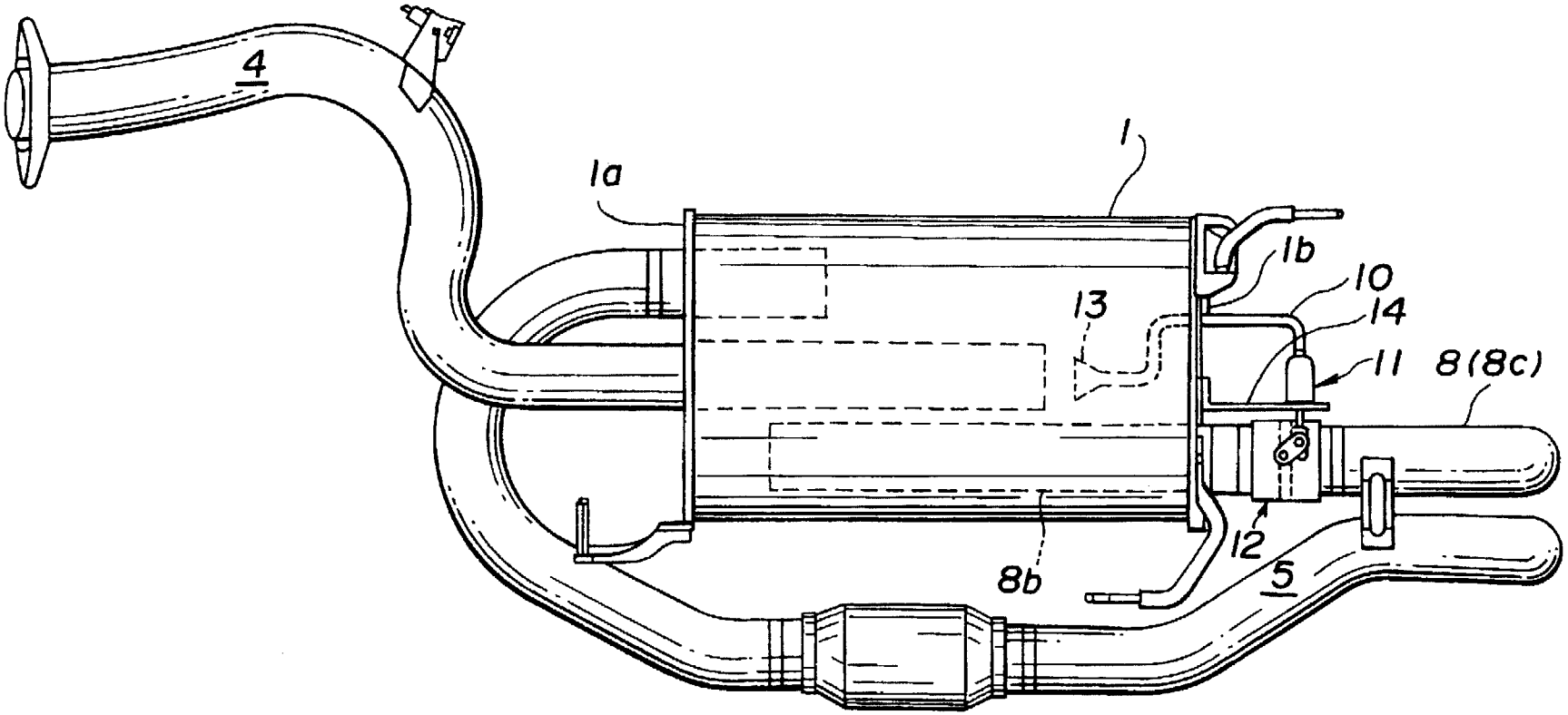
FIG. 2 is a plan view of the the muffler controller of the first embodiment.
Figure 3:
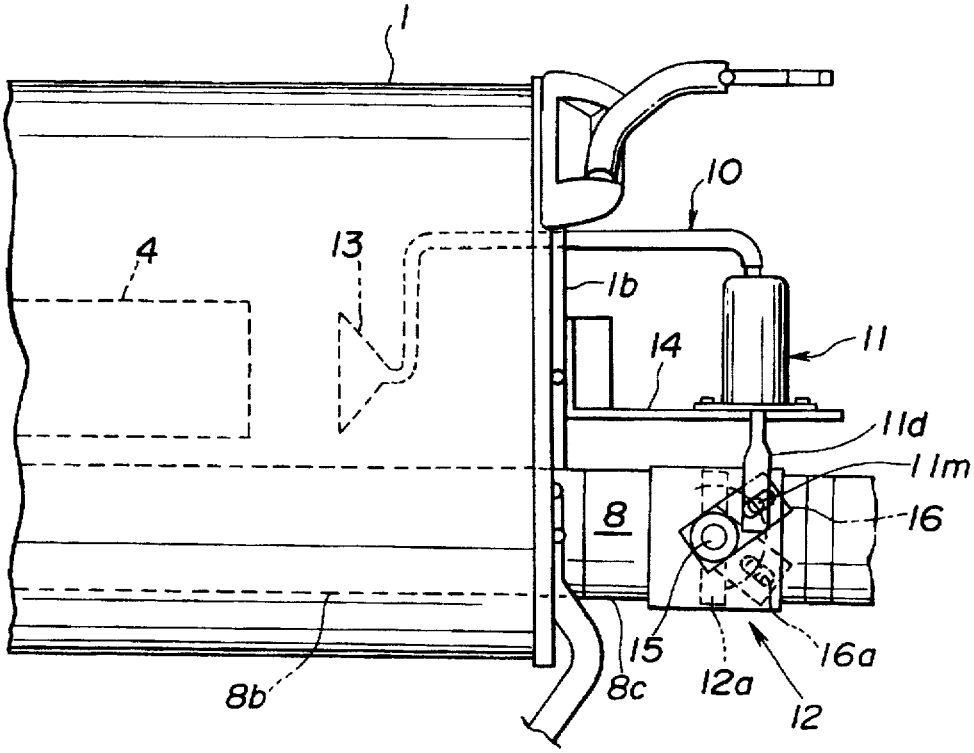
FIG. 3 is an enlarged plan view of an essential portion of the muffler assembly having a controller of the first embodiment.
Figure 4:
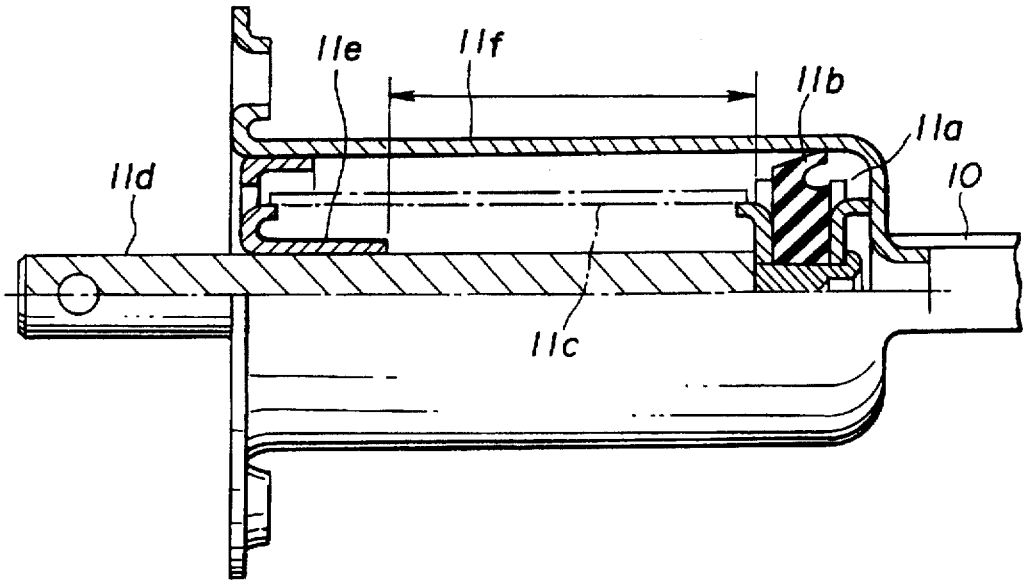
FIG. 4 is a partially sectioned view of a cylinder type actuator employed in the muffler controller of the invention.

Referring to FIGS. 2, 3 and 4, particularly FIGS. 2 and 3, the controllable exhaust system is shown.

In FIGS. 2 and 3, denoted by numeral 1 is an exhaust muffler. Although not shown, a plurality of partition walls are installed in the muffler to define therein a plurality of expansion and resonance chambers. Denoted by numeral 4 is an exhaust gas inlet tube, which has a rear end portion projecting into the muffler 1. A front end of the tube 4 is connected to an outlet port of a catalytic converter (not shown). First and second exhaust gas outlet tubes 5 and 8 extend from the interior of the muffler 1.

The first exhaust gas outlet tube 5 has a front portion projecting into the muffler 1 from a front wall 1*a* of the muffler 1. The second exhaust gas outlet tube 8 has a front half portion 8*b* projecting into the muffler 1 from a rear wall 1*b* of the muffler 1. A rear half portion 8*c* of the second exhaust tube 8 is exposed to the outside of the muffler 1, as shown.

Thus, the muffler 1, has two exhaust flow passages respectively associated with the first and second exhaust gas outlet tubes 5 and 8.

The muffler controller of the invention is associated with the exhaust system having the above-mentioned construction.

The muffler controller shown in FIGS. 1 to 4 is a first embodiment of the present invention, which, as is seen from FIG. 2, comprises a pressure induction pipe 10, a pneumatic actuator 11 and a valve assembly 12.

As best shown in FIG. 3, the pressure induction pipe 10 has a tapered open end 13 the muffler 1. The tapered open end 13 is directed toward a rear open end of the exhaust gas inlet tube 4. The other open end of the pipe 10 is connected to the pneumatic actuator 11. Thus, a positive pressure consisting of static and dynamic pressures created in the muffler 1 is led into the pneumatic actuator 11.

As seen from FIG. 4, the pneumatic actuator 11 comprises a cylindrical casing 11*f*, an annular piston 11*b* slidably received in the casing 11*f* to define a work chamber 11*a*, a coil spring 11*c* installed in the casing 11*f* to bias the annular piston 11*b*, and a piston rod 11*d* toward the retracted position (rightward in FIG. 4). The position rod 11*d* extending leftward from the annular piston 11*b* to the outside of the casing 11*f* A stopper 11*e* is installed in the casing 11*f* to stop excessive leftward displacement of the piston 11*b*. The inner surface of the cylindrical casing 11*f* is lined with a lubricant plastic to smooth the movement of the piston 11*b* in the casing 11*f*. The work chamber 11*a* is connected to the other open end of the pressure induction pipe 10. Thus, when the positive pressure is led into the work chamber 11*a* through the pipe 10, the piston 11*b* is slid leftward in FIG. 4 against the biasing force of the spring 11*c* thereby pushing out the piston rod 11*d*.

Referring back to FIG. 3, the pneumatic actuator 11 is mounted on a bracket 14 secured to the rear wall 1*b* of the muffler 1. The piston rod 11*d* of the actuator 11 is operatively connected to the valve assembly 12 as described below.

The valve assembly 12 is mounted to the rear half portion 8*c* of the second exhaust gas outlet tube 8 extending outward from the muffler 1. The valve assembly 12 comprises a butterfly plate 12*a*, which is pivotally installed in the rear half portion 8*c* of the tube 8 through a pivot shaft 15. That is, the butterfly plate 12*a* is secured to the pivot shaft 15 to pivot therewith about the axis of the pivot shaft 15.

The pivot shaft 15 is connected to the piston rod 11*d* of the actuator 11 through one link 16. That is, the link 16 is secured at one end portion to the pivot shaft 15 to pivot therewith. The other end portion of the link 16 is formed with an elongated opening 16*a* that extends longitudinally. A pin 11*m* fixed to the leading end of the piston rod 11*d* is slidably engaged with the elongated opening 16*a*.

In the following, operation of the muffler controller of the first embodiment will be described with respect to FIGS. 2 and 3.

For ease of understanding, the description will be commenced with respect to a standstill condition of the engine.

Under this rest condition, the butterfly valve 12*a* of the valve assembly 12 assumes the fully closed position due to the force of the biasing spring 11*c* of the actuator 11. Thus, the flow passage of the second exhaust gas outlet tube 8 is fully closed.

When now the engine is started, the exhaust gas from the engine is fed into the muffler 1 through the exhaust gas inlet tube 4. Under this condition, the exhaust gas flows in only the exhaust flow passage associated with the first exhaust gas outlet tube 5 while loosing its energy.

When the engine speed is increased by depressing an accelerator pedal (not shown), the pressure of the exhaust gas is increased accordingly.

When the engine speed is further increased and comes a certain level, for example, about 1500 rpm, the increased pressure of the exhaust gas fed to the work chamber 11*a* of the actuator 11 starts to move the piston rod 11*d* against the force of the biasing spring 11*c* in the direction to open the butterfly plate 12*a*. Upon this, the second exhaust gas outlet tube 8 becomes partially operative. That is, in addition to the exhaust gas flow directed toward the first exhaust gas outlet tube 5, the muffler 1 produces another exhaust gas flow directed toward the second exhaust gas outlet tube 8.

When the engine speed is further increased and thus the pressure of the exhaust gas is further increased, the butterfly plate 12*a* increases its opening degree. Thus, the resistance of the muffler 1 against the flow of the exhaust gas flowing therein is greatly reduced.

The operation of the muffler controller of the first embodiment will be much apparent from the following description.

OPERATION OF ACTUATOR 11

When, during operation of the engine, the exhaust gas is led into the work chamber 11*a* of the actuator 11 through the pressure induction pipe 10, the piston rod 11*d* of the actuator 11 is moved in accordance with the magnitude of the pressure of the exhaust gas.

Figure 5:
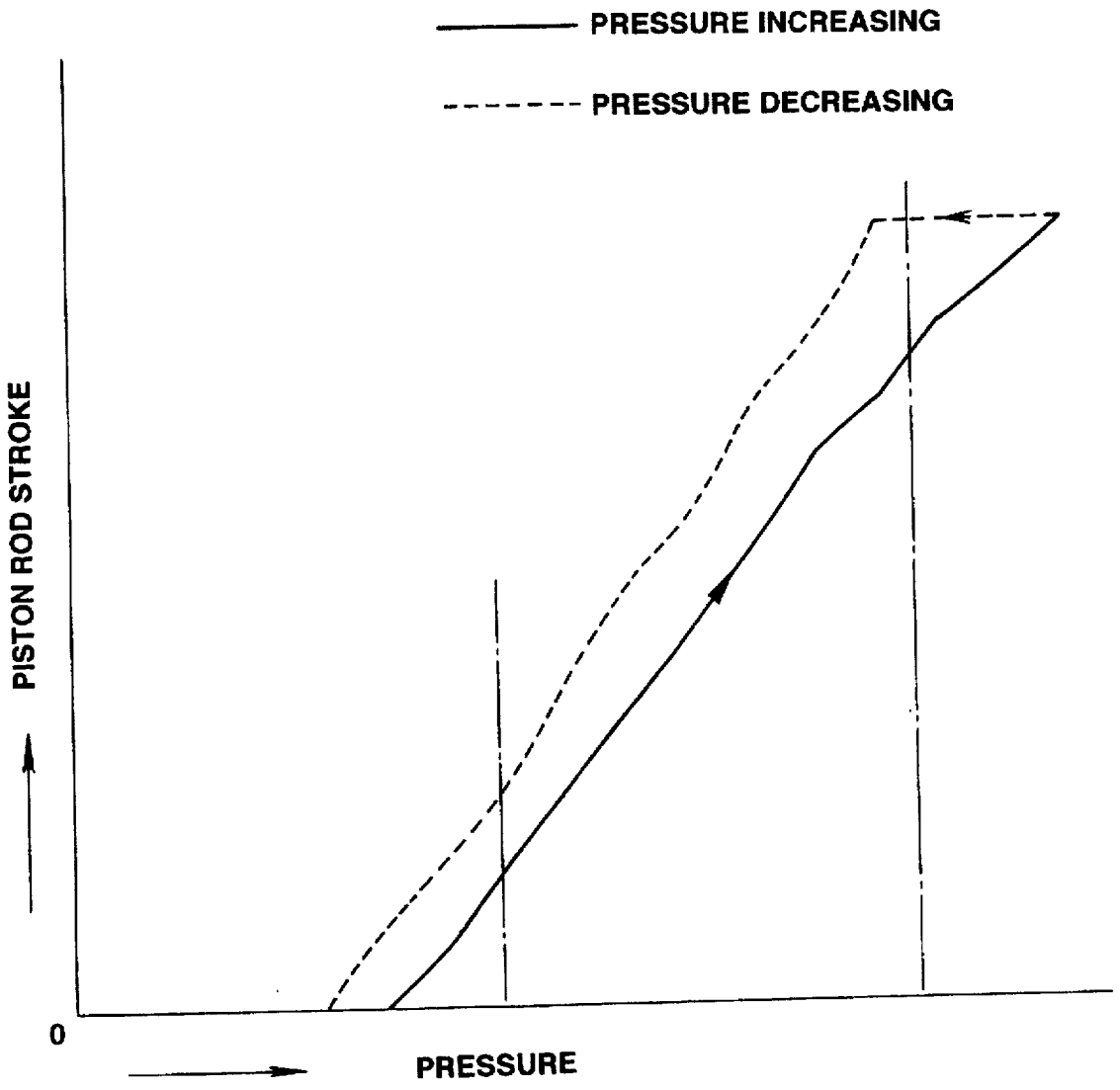
FIG. 5 is a graph showing the characteristic of the cylinder type actuator in terms of the relationship between a pressure fed to the actuator and a piston stroke of the actuator.

The stroke characteristic of the piston rod 11*d* with respect to the magnitude of the pressure fed to the actuator 11 is shown in the graph of FIG. 5. As is seen from this graph, the stroke characteristic of the piston rod 11*d* obtained when the pressure in the work chamber 11*a* is increasing is different from that of the piston rod 11*d* obtained when the pressure in the work chamber 11*a* is decreasing. That is, the stroke of the piston rod 11*d* has a certain hysteresis between the pressure increasing mode and the pressure decreasing mode of the actuator 11. This hysteresis results from an inevitable friction of the piston 11*b* against the plastic-lined inner wall of the casing 11*f* of the actuator 11. Accordingly, when the exhaust pressure fed to the work chamber 11*a* has a certain fluctuation, the hysteretic pressure range can serve as a damping zone for the fluctuation. Thus, the undesired hunting of the valve assembly 12 can be eliminated.

Since the tapered open end 13 of the pressure induction pipe 10 is arranged to face the rear open end of the exhaust gas inlet tube 4, the pipe 10 can catch the dynamic pressure of the exhaust gas as well as the static pressure of the same. This means a certain increase in pressure level of the positive pressure fed to the actuator 11. Thus the valve actuating operation of the actuator 11 is enhanced.

PRESSURE REGULATING FUNCTION

Under operation of the engine, the pressure of the exhaust gas emitted from the engine fluctuates in accordance with the speed of the engine. Thus, if such exhaust gas is directly fed to the work chamber 11*a* of the actuator 11, the movement of the piston rod 11*d* would be severely affected by the pressure fluctuation. In fact, the opening and closing movement of the butterfly plate 12*a* of the valve assembly 12 would be severely fluctuated in such case.

However, in case of the first embodiment, such apprehension is suppressed due to positioning of the tapered open end 13 of the pressure induction pipe 10 in the muffler 1. As is known, when the exhaust gas is led into the muffler 1 and thus expanded, the pressure fluctuation of the same is reduced and thus regulated. This pressure regulating function becomes most effective when the engine is under a low speed operation.

OPERATION OF VALVE ASSEMBLY 12 UNDER ACCELERATION OF ENGINE

When, for accelerating the vehicle, the accelerator pedal is depressed and thus the speed of the engine increases, the pressure of the exhaust gas is increased. With this, the positive pressure in the muffler 1 and thus the pressure in the work chamber 11*a* of the actuator 11 is increased. Thus, the butterfly plate 12*a* of the valve assembly 12 is turned from the fully closed position toward the fully opened position. The turning of the butterfly plate 12*a* is continuously or steplessly carried out and thus smooth vehicle acceleration and ear-agreeable exhaust sound are obtained.

Figure 6:
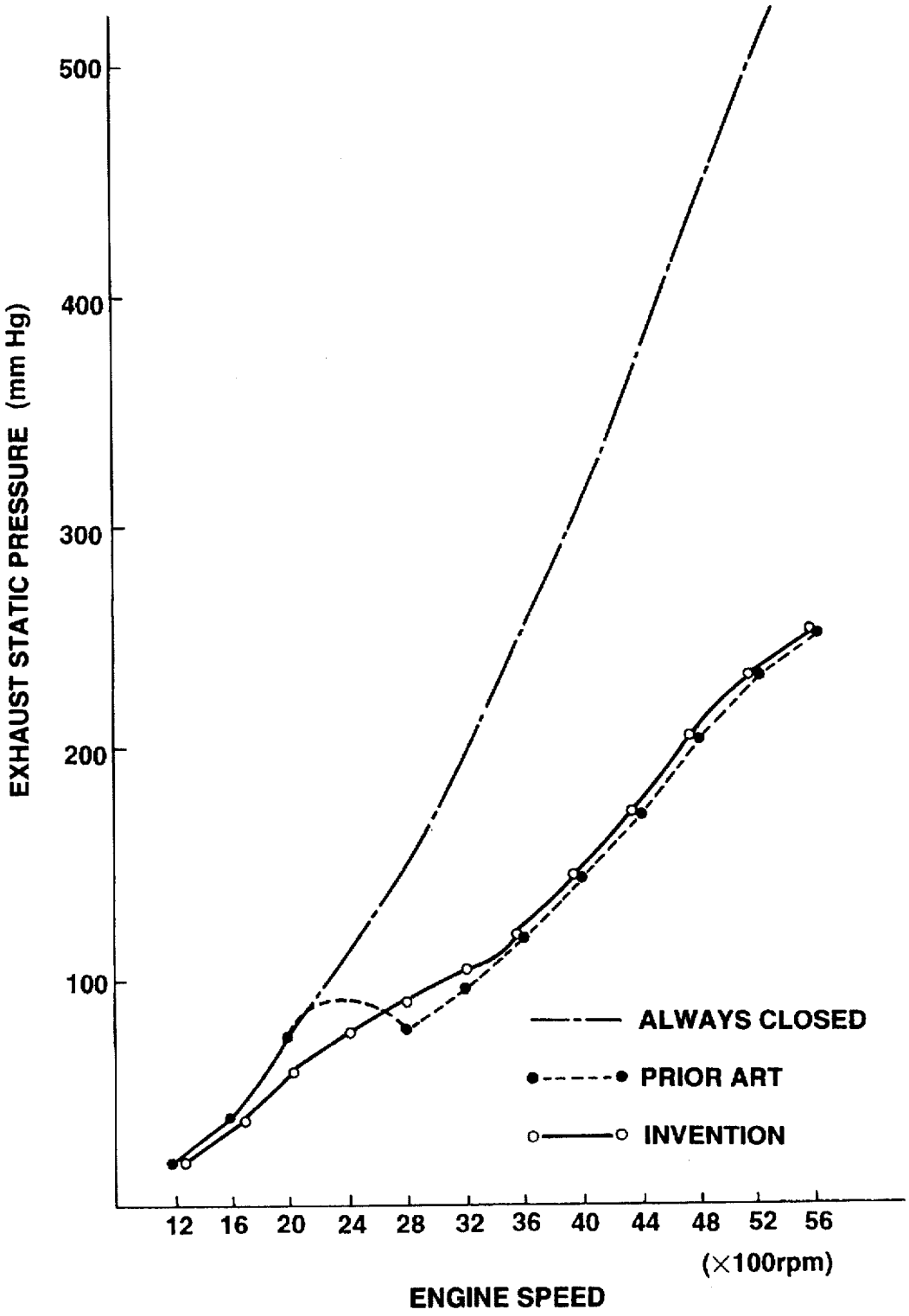
FIG. 6 is a graph showing both an exhaust pressure control performance exhibited by the muffler controller of the invention and that exhibited by a conventional muffler controller, the performance being depicted in terms of the relationship between a static pressure of the exhaust gas and an engine speed.
Figure 7:
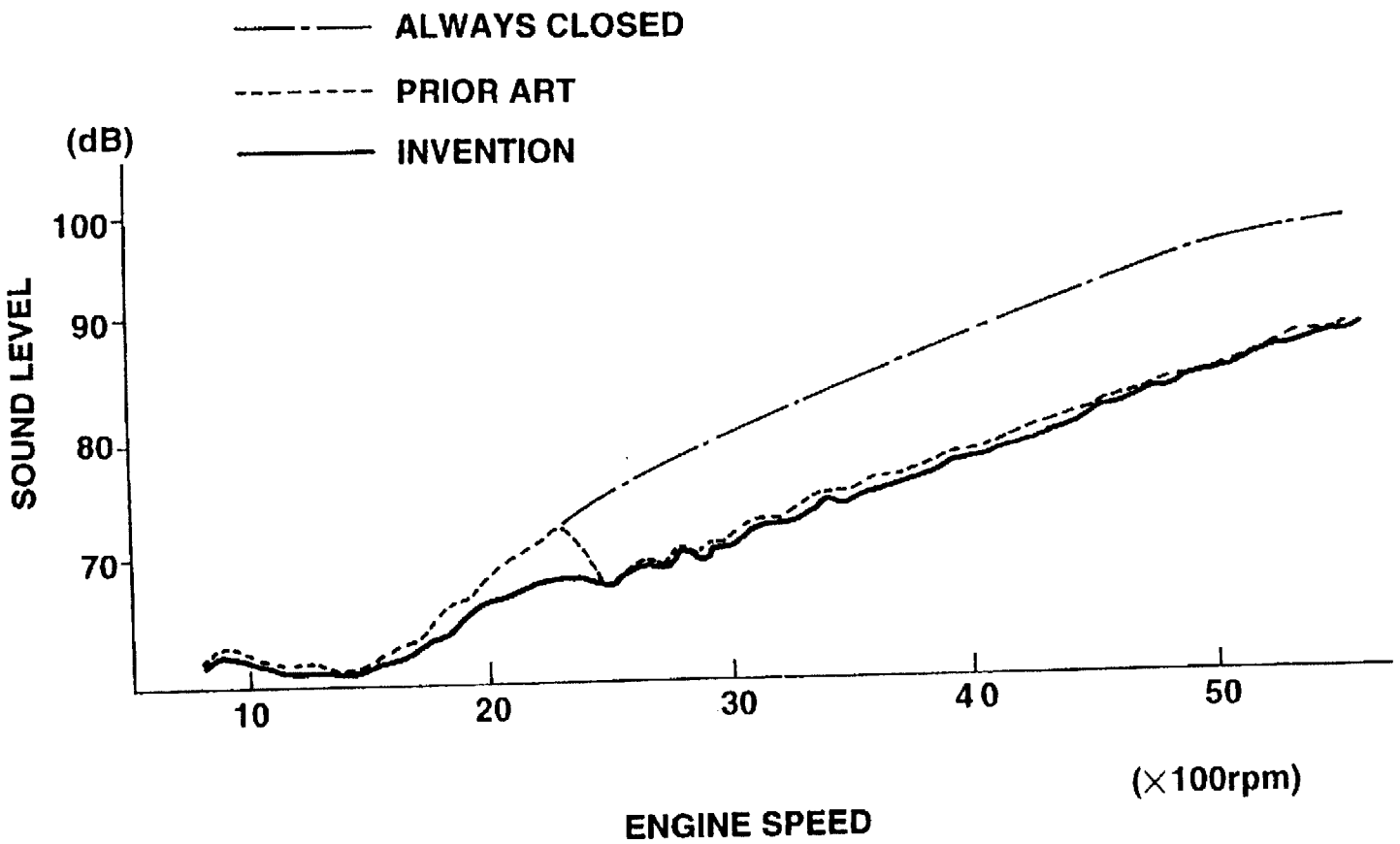
FIG. 7 is a graph showing both an exhaust sound control performance exhibited by the muffler controller of the invention and that exhibited by the conventional muffler controller, the performance being depicted in terms of the relationship between an exhaust sound level and the engine speed.
Figure 8:
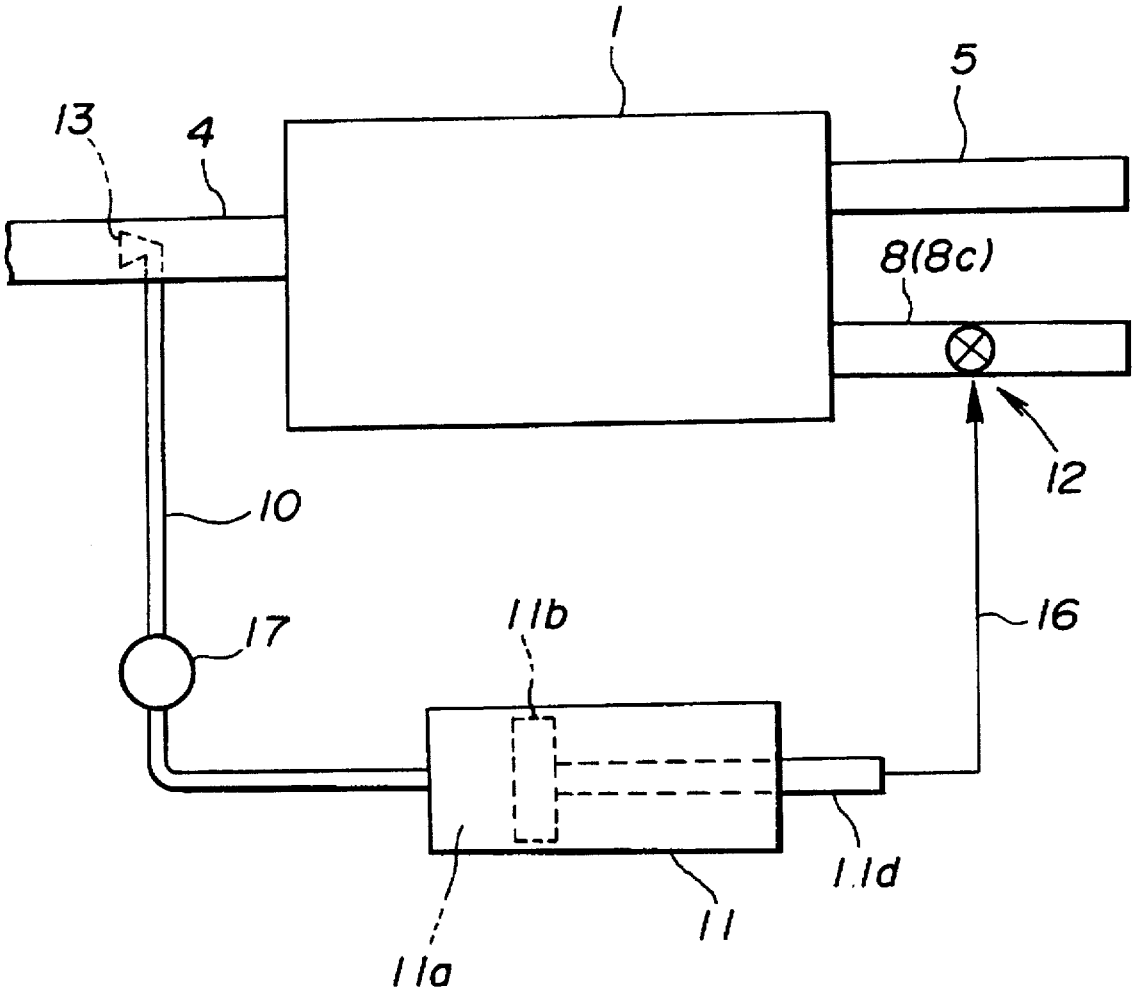
FIG. 8 is a view similar to FIG. 1, but showing a muffler controller of a second embodiment of the present invention.

These advantageous phenomena will be readily understood from the graphs of FIGS. 6 and 7.

FIG. 6 shows both an exhaust pressure control performance exhibited by the muffler controller of the invention and that exhibited by a conventional muffler controller. In the conventional muffler controller, an ON/OFF type control valve, which controls a valve proper in ON/OFF manner, is employed so that the valve proper can take only a fully closed position and a fully open position.

As is seen from this graph, in the conventional muffler controller (whose characteristic is depicted by the curve of dotted line), the exhaust static pressure is suddenly dropped at a certain engine speed (viz., about 2400 rpm) during the time when the engine speed is increasing. The sudden drop is produced when the valve proper changes its position suddenly from the fully closed position to the fully open position. Of course, in this case, smooth vehicle acceleration is not expected. However, in case of the invention (whose characteristic is depicted by the curve of solid line), such undesired pressure drop does not appear. This is because of the stepless movement of the butterfly plate 12*a* of the valve assembly 12. The butterfly plate 12*a* varies the opening degree in the second exhaust gas outlet tube 8. That is, with increase of engine speed, the exhaust static pressure increases substantially linearly, and due to the gradually opening movement of the butterfly plate 12, the exhaust resistance is gradually decreased, which provides the vehicle with a smooth acceleration.

The curve illustrated by a phantom line shows a case wherein the butterfly valve 12*a* is kept closed intentionally throughout the increase in engine speed.

FIG. 7 shows both an exhaust sound controlling performance exhibited by the muffler controller of the invention and that exhibited by the conventional muffler controller.

As is seen from this graph, in the conventional muffler controller (whose characteristic is depicted by the curve of dotted line), the exhaust sound is suddenly dropped at the certain engine speed (viz., about 2400 rpm) during increase in engine speed. This sound drop is not agreeable to the ear. However, in the present invention (whose characteristic is depicted by the curve of solid line), such undesired sound drop is not produced. Thus, ear-agreeable exhaust sound is obtained.

The curve illustrated by a phantom line shows a case where the butterfly valve 12*a* is kept closed intentionally throughout the increase in engine speed.

APPLICATION TO MOTOR VEHICLE

In the invention, the exhaust gas from the engine is used as a power for driving the valve assembly 12. Thus, the muffler controller can be manufactured at low cost as compared with other exhaust systems in which electric actuators are used for actuating the control valve.

FUNCTION OF SPRING 11*c* OF ACTUATOR 11

The critical pressure at which the actuator 11 starts the opening operation of the valve assembly 12 (viz., butterfly plate 12*a*) is determined by the biasing spring 11*c* installed in the actuator 11. As has been mentioned before, in a rest condition of the engine, the valve assembly 12 fully closes the flow passage of the second exhaust gas outlet tube 8 due to the force of the biasing spring 11*c*. This means that the biasing spring 11*c* constitutes a part of a so-called "fail safe system". That is, if, due to breakage of the pressure induction pipe 10 or the like, the work chamber 11*a* of the actuator 11 fails to receive a satisfied positive pressure, the butterfly plate 12*a* takes automatically the fully closed position by the function of the biasing spring 11*c*.

MOVEMENT OF PISTON 11*b* IN CASING 11*f*

Due to pressure increase and decrease in the work chamber 11*a* caused by the exhaust gas fed thereto from the muffler 1, the piston 11*b* reciprocates in the casing 11*f*. This reciprocating movement of the piston 11*b* is smoothly carried out because the inner surface of the casing 11*f* is lined with a lubricant plastic. That is, a so-called "sticky movement" of the piston 11*b* is suppressed. This induces a smooth opening and closing pivoting of the butterfly plate 12*a* of the valve assembly 12.

Figure 9:
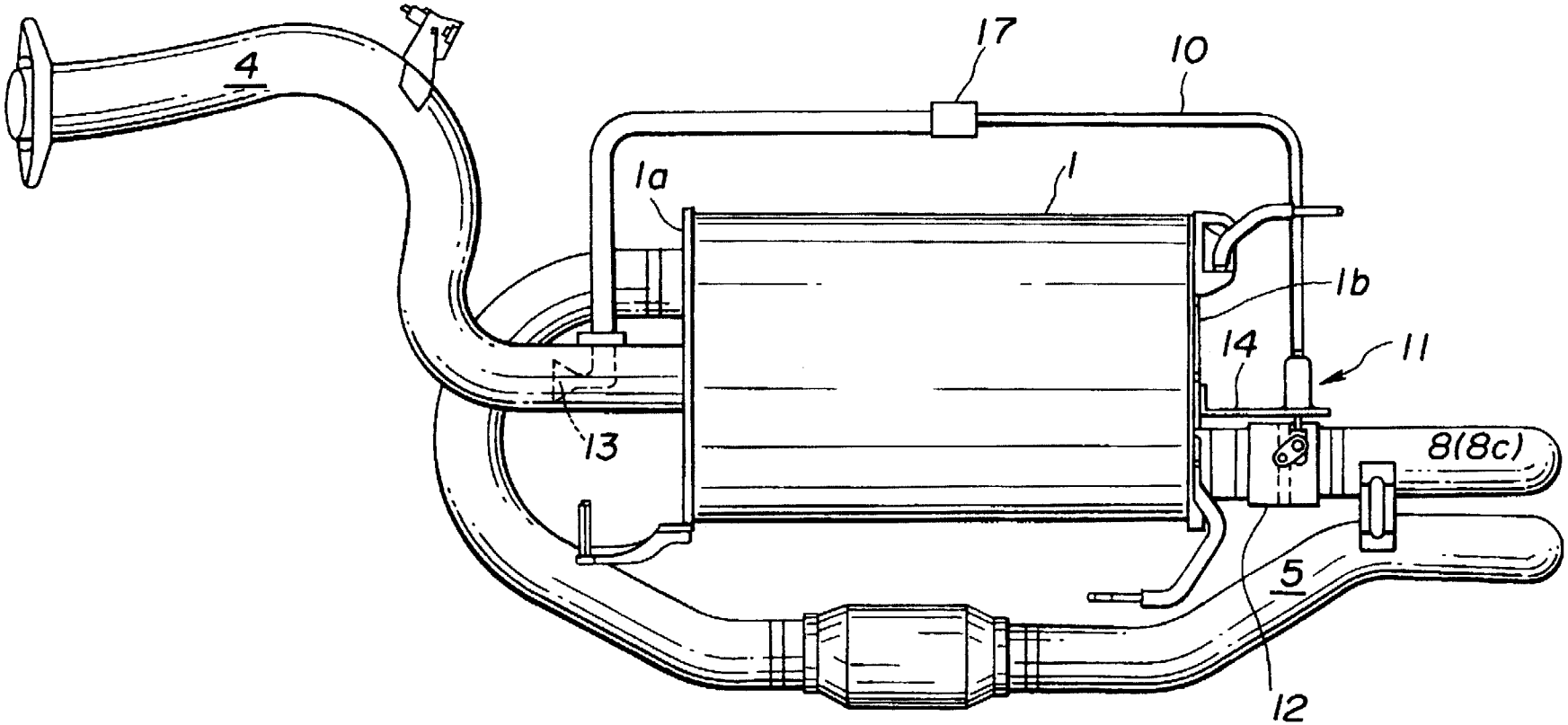
FIG. 9 is a view similar to FIG. 2, but showing the muffler controller of the second embodiment.

Referring to FIGS. 8 to 11, particularly FIG. 9, there is shown a muffler controller of a second embodiment of the present invention.

Since the muffler controller of this embodiment is similar in construction to that of the first embodiment, only parts and arrangement that are different from those of the first embodiment will be described below.

As seen from FIG. 9, in the second embodiment, the tapered open end 13 of the pressure induction pipe 10 is led into the exhaust gas inlet tube 4 and faces upstream of the exhaust gas flowing in the tube 4.

Figure 10A:
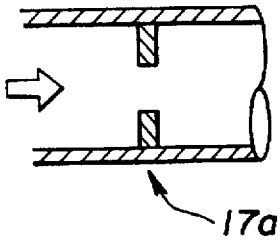
FIGS. 10A, 10B, 10C, and 10D are sectional views of four types of an orifice member, which can be installed in a pressure induction pipe used in the second embodiment.
Figure 10B:
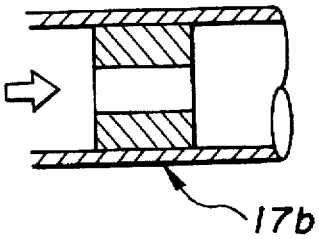
Figure 10C:
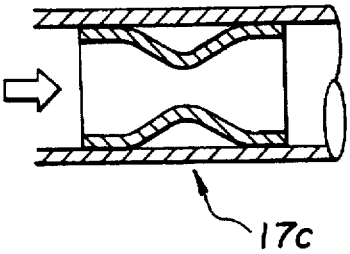
Figure 10D:
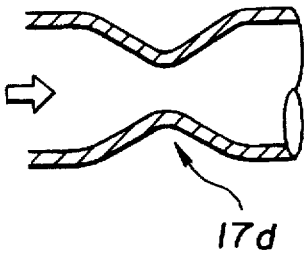

An orifice member 17 is connected to the pressure induction tube 10. The orifice member 17 may have one of the structures illustrated in FIGS. 10A, 10B, 10C and 10D. In the structure of FIG. 10A, a partition wall 17*a* having a center opening is used, and in the structure of FIG. 10B, a tubular piece 17*b* is used. In the structure of FIG. 10C, a venturi tube 17*c* is used, and in the structure of FIG. 10D, a choke portion 17*d* is defined by the pipe 10.

Thus, in this embodiment, the pressure in the exhaust gas inlet tube 4 is fed to the work chamber 11*a* of the actuator 11. However, due to the pressure regulating function of the orifice member 17, the undesired pressure fluctuation of the exhaust gas in the tube 4 is suppressed to smoothly operate the actuator 11 and that of the butterfly valve 12*a* of the valve assembly.

Because the tapered open end 13*a* of the pipe 10 faces the exhaust gas flow in the exhaust gas inlet tube 4, the pipe 10 can catch the dynamic pressure of the exhaust gas as well as the static pressure of the same.

Figure 11:
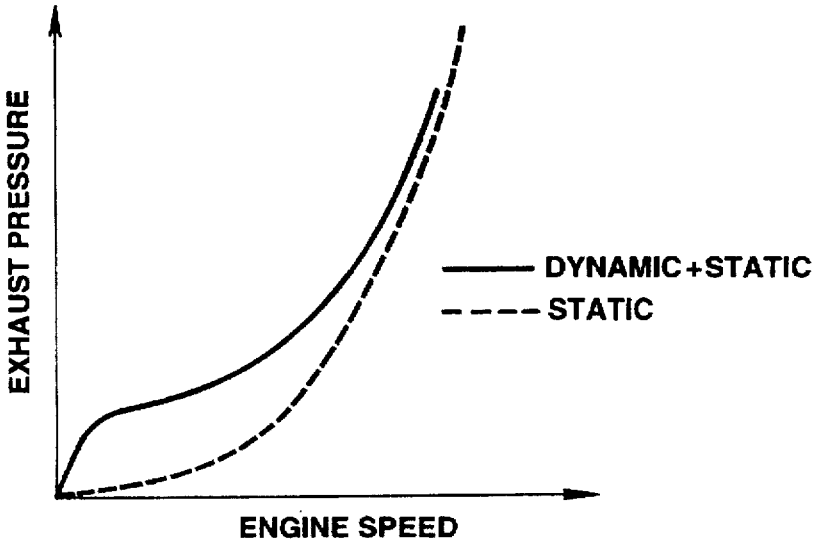
FIG. 11 is a graph showing the exhaust pressure practically fed to an actuator through the pressure induction pipe used in the second embodiment, the exhaust pressure being plotted in accordance with the engine speed.
Figure 12:
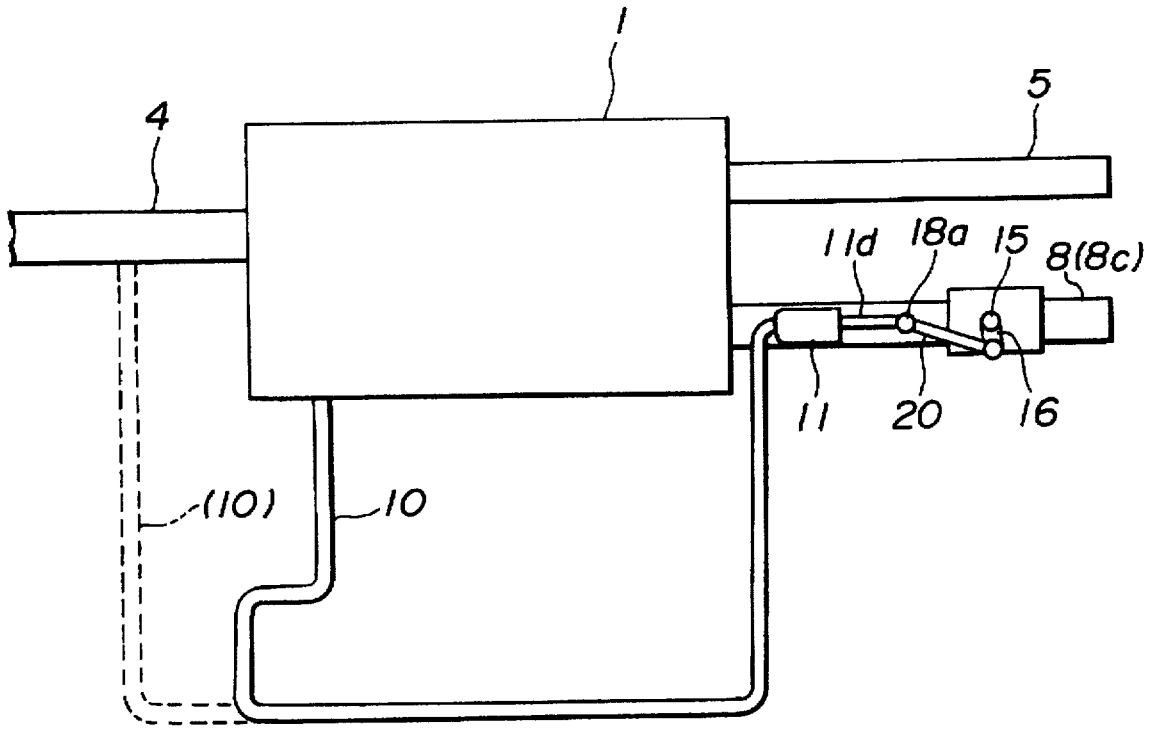
FIG. 12 is a view similar to FIG. 1, but showing a muffler controller of a third embodiment of the present invention.

These advantageous phenomena will be understood from the graph of FIG. 11, which shows the positive pressure caught by the pressure induction pipe 10 with respect to the engine speed. The curve illustrated by a solid line shows the caught pressure when the tapered open end 13 faces the exhaust gas flow, while the curve illustrated by a dotted line shows the caught pressure when the tapered open end 13 faces perpendicular to the flow.

Figure 13:
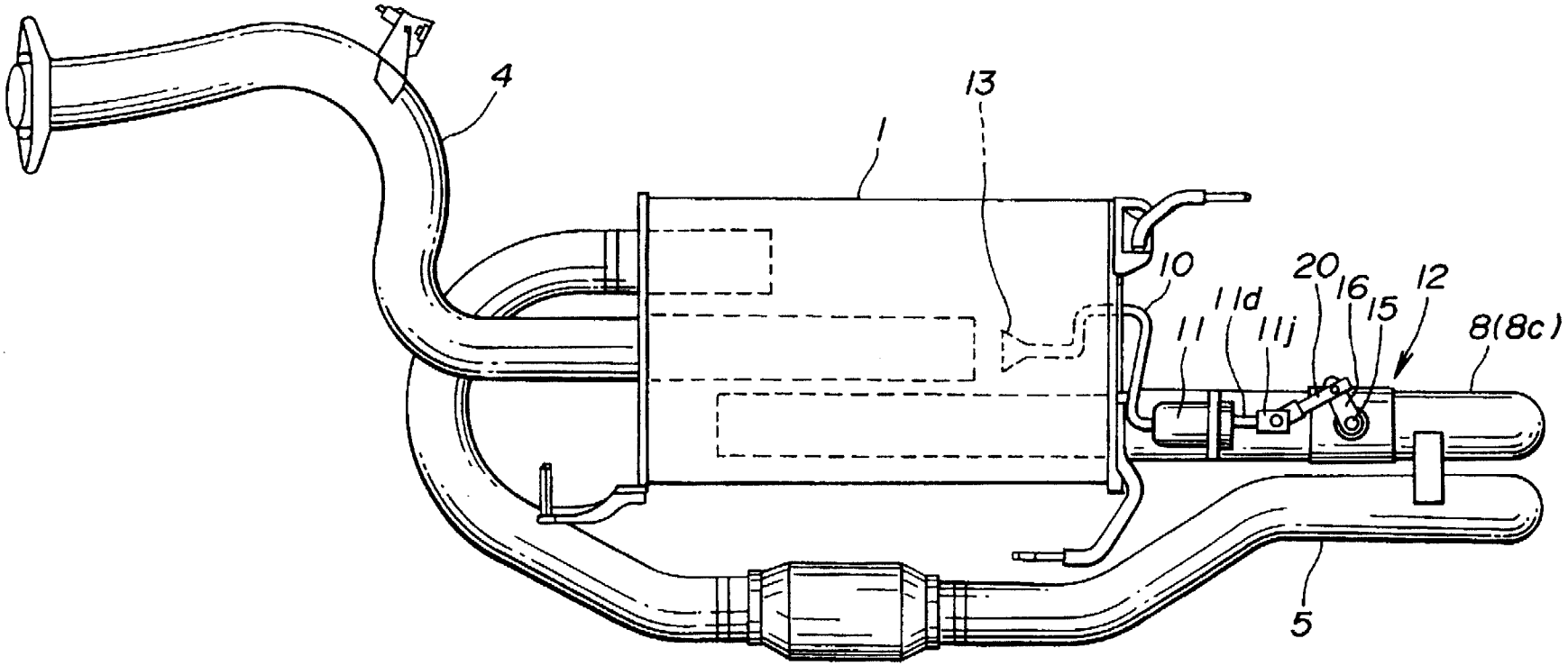
FIG. 13 is a view similar to FIG. 2, but showing the muffler controller of the third embodiment.
Figure 14:
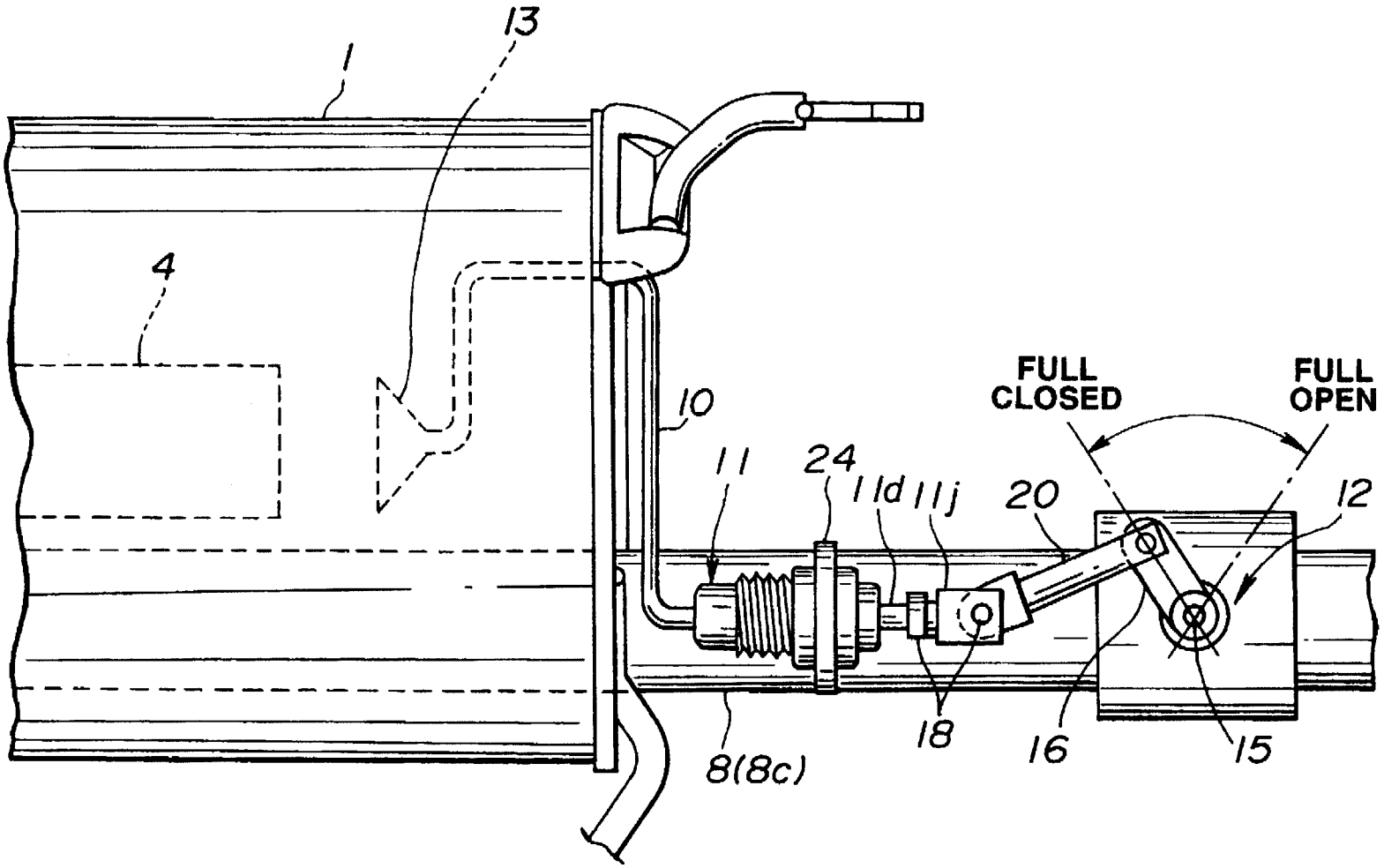
FIG. 14 is an enlarged plan view of an essential portion of the muffler controller of the third embodiment.

Referring to FIGS. 12 to 18, particularly FIGS. 13 and 14, there is shown a muffler controller of a third embodiment of the present invention.

Since the muffler controller of this third embodiment is similar in construction to that of the first embodiment, only parts and arrangement that are different from those of the first embodiment will be described below.

Figure 16:
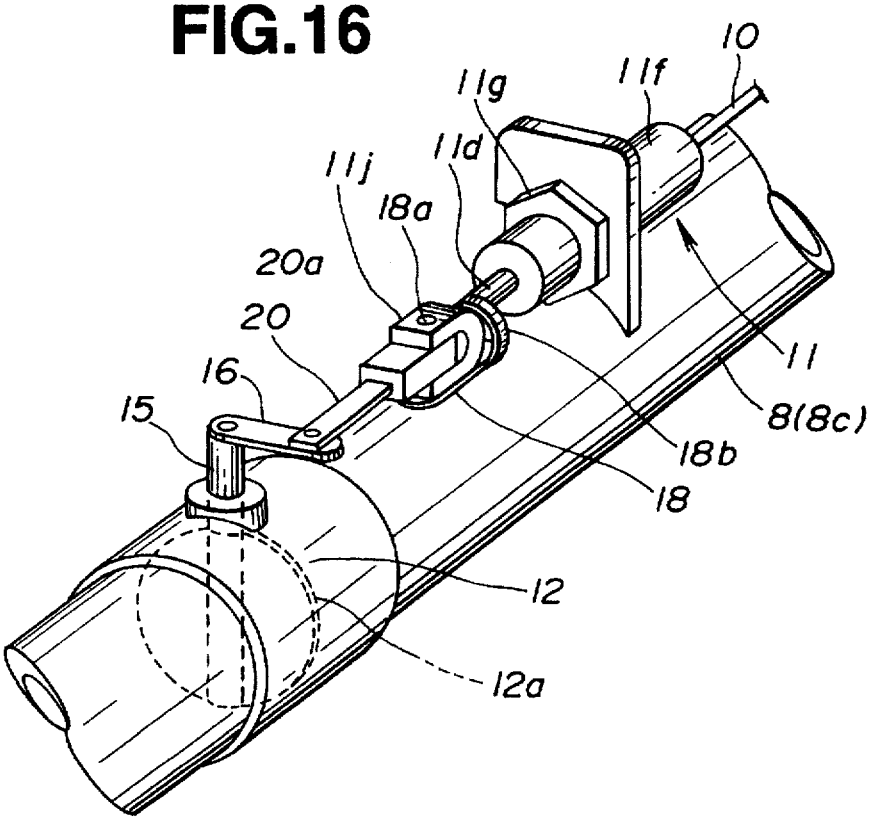
FIG. 16 is a perspective view of the muffler controller of the third embodiment.

As seen from FIG. 14, in the third embodiment, the pneumatic actuator 11 is mounted on the second exhaust gas outlet tube 8 (8*c*) through a mounting bracket 24, which, as is shown in FIG. 16, is raised from the tube 8.

Figure 15:
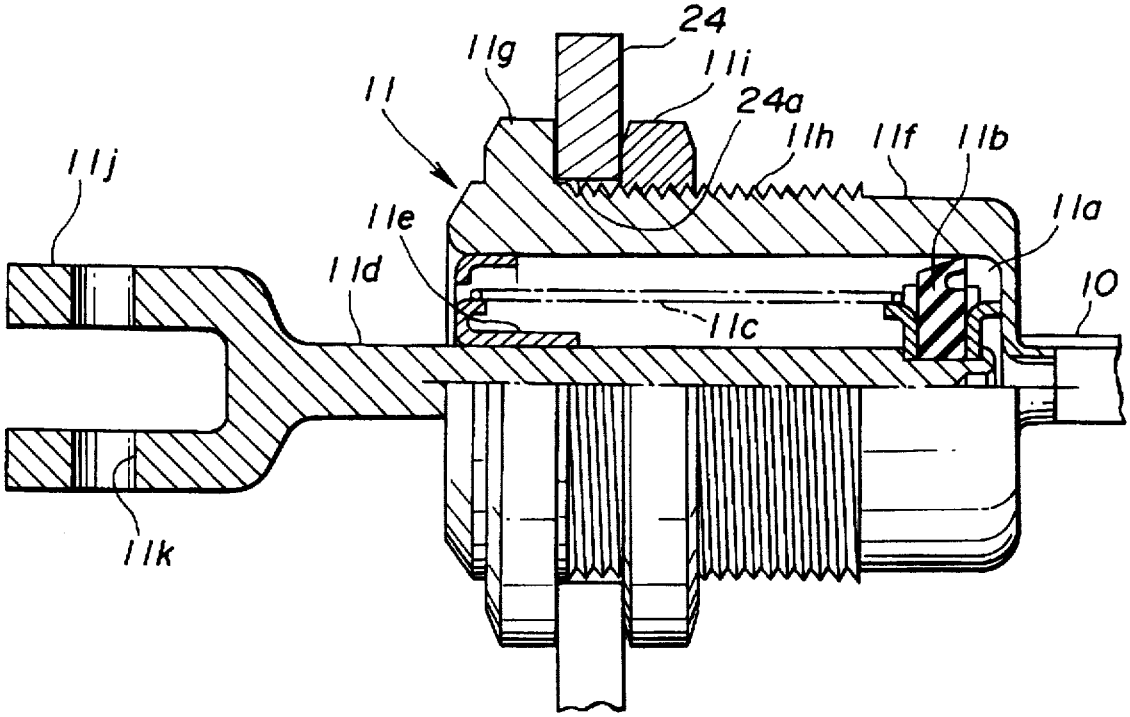
FIG. 15 is a partially sectioned enlarged view of an actuator used in the third embodiment.

As best shown in FIG. 15, the cylindrical casing 11*f* of the actuator 11 is formed with a threaded outer surface 11*h* with which a nut 11*i* is engaged. A flange 11*g* is integrally formed on one end of the casing 11*f*. The mounting bracket 24 has an aperture 24*a* through which the cylindrical casing 11*f* is inserted. By turning the nut 11*i* in the fastening direction, the actuator 11 is secured to the bracket 24.

The piston rod lid of the actuator 11 is formed with a fork-like end portion 11*j*.

As seen from FIG. 16, the link mechanism for operatively connecting the pivot shaft 15 of the valve assembly 12 with the piston rod 11*d* of the actuator 11 comprises the fork-like end portion 11*j* of the piston rod 11*d*, the second link 20, and the first link 16. The second link 20 is formed at one end with an enlarged portion 20*a* (see FIG. 17), which is sandwiched in a clearance, between two arms (no numerals) of the fork-like end portion 11*j* and pivotally connected thereto through a pivot pin 18*a*. The other end of the second link 20 is pivotally connected to one end of the first link 16 secured at the other end to the pivot shaft 15 of the butterfly plate 12*a*.

Figure 17:
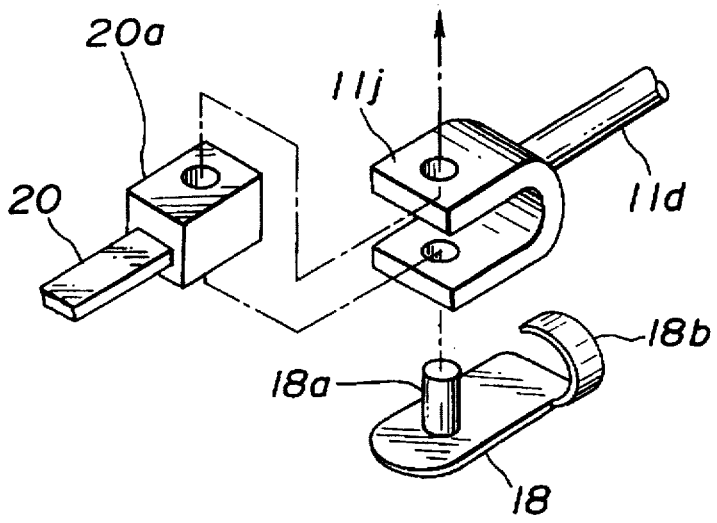
FIG. 17 is an exploded view of a link mechanism employed in the muffler controller of the third embodiment.

As understood from FIG. 17, the pivot pin 18*a* is provided on a support plate 18, which has a resilient holding pawl 18*b*. As is seen from FIG. 18, upon assembly, the holding pawl 18*b* is hooked to the piston rod 11*d* to hold the pivot pin 18*a* in place.

Figure 18:
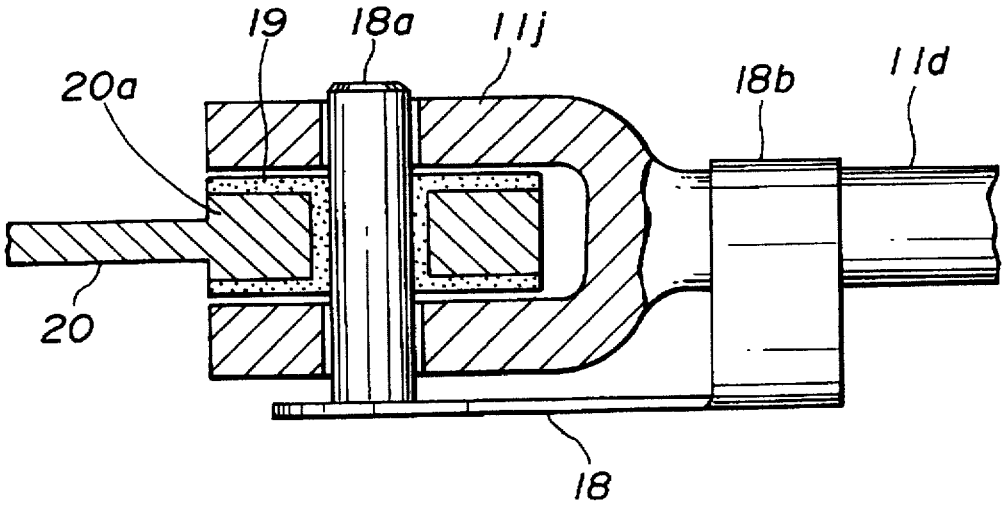
FIG. 18 is a sectional view of the link mechanism in assembled condition.

As seen from FIG. 18, the enlarged portion 20*a* of the second link 20 is entirely lined with a thermally insulating film 19.

Thus, in the third embodiment, due to provision of this insulating film 19, undesired thermal transmission from the second link 20 to the piston rod 11*d* is minimized, which lengthens the life of the actuator 11, particularly the life of the sealing member of the piston 11*b*.

Because of the robust structure of the link mechanism employed in this embodiment, the movement of the piston rod 11*d* of the actuator 11 is assuredly transmitted to the butterfly plate 12*a* of the valve assembly 12.

The pivot pin 11*a* can be readily removed from the fork-like end portion 11*j* by pulling and disengaging the holding pawl 18*b* from the piston rod 11*d*. Thus, the maintenance of the link mechanism and thus that of the muffler controller is easily achieved.

What is claimed is:

1. A muffler assembly for an exhaust system of an internal combustion engine, comprising:

a muffler; and an exhaust gas inlet tube connected to the muffler to feed the exhaust gas from the engine into the muffler;

means defining first and second exhaust gas outlet passages connected to the muffler for exhausting the exhaust gas from the muffler through at least one of the outlet passages;

a valve assembly having a pivot shaft and a valve plate connected to the pivot shaft, the valve plate being situated in the second outlet passage and pivotally movable in the second outlet passage to control the exhaust-gas flow through the second outlet passage;

a pneumatic actuator having a reciprocating piston rod and a work chamber;

means for feeding the exhaust gas to the work chamber; and a link mechanism operatively connected to the piston rod and the pivot shaft so that reciprocating motion of the piston rod induces the valve plate to pivot and control the exhaust-gas flow through the second outlet passage, wherein the amount of piston rod reciprocation, thus the amount of valve plate opening in the second outlet passage, is controlled by pressure developed in the work chamber.

2. A muffler assembly as claimed in claim 1, wherein the feeding means is a pressure induction pipe having a first tapered open end exposed to an interior of the muffler and a second open end connected to the work chamber.

3. A muffler assembly as claimed in claim 2, wherein the first tapered open end is directed upstream toward an open end of the exhaust gas inlet tube.

4. A muffler assembly as claimed in claim 1, wherein the feeding means is a pressure induction pipe having a first tapered open end exposed to an interior of the inlet tube and a second open end connected to the work chamber.

5. A muffler assembly as claimed in claim 4, wherein the first tapered open end is directed upstream against the exhaust gas flow in the inlet tube.

6. A muffler assembly as claimed in claim 1, wherein the link mechanism comprises a link having one end portion secured to the pivot shaft, a longitudinally extending elongated opening formed in the other end portion of the link, and a pin secured to the piston rod and slideably engaged with the elongated opening.

7. A muffler assembly as claimed in claim 4, further comprising an orifice member operatively disposed in the pressure induction pipe.

8. A muffler assembly as claimed in claim 7, wherein the orifice member is a partition wall having a center opening formed therethrough.

9. A muffler assembly as claimed in claim 7, wherein the orifice member is a tubular piece having a thin passage formed therethrough.

10. A muffler assembly as claimed in claim 7, wherein the orifice member is a venturi tube having a choke portion.

11. A muffler assembly as claimed in claim 7, wherein the orifice member is a choke portion integral with the pressure induction pipe.

12. A muffler assembly as claimed in claim 1, wherein the link mechanism comprises a first link having one end secured to the pivot shaft, a second link having one end pivotally connected to the other end of the first link, and a fork-like end portion formed with the piston rod, the fork-like end portion being pivotally connected to the other end of the second link.

13. A muffler assembly as claimed in claim 12, wherein the other end of the second link is enlarged and sandwiched in a clearance defined between two arms of the fork-like end portion, and pivotally connected thereto through a pivot pin.

14. A muffler assembly as claimed in claim 13, wherein the pivot pin is provided on a support plate, which has a resilient holding pawl, the holding pawl being hooked to the piston rod to hold the pivot pin in place.

15. A muffler assembly as claimed in claim 13, wherein the enlarged end of the second link is entirely lined with a thermally insulating film, thereby to establish a thermal insulation between the enlarged end and the fork-like end portion.

16. A muffler assembly for an exhaust system of an internal combustion engine, comprising:

a muffler;

an exhaust gas inlet tube having a downstream portion projecting into the muffler to feed the exhaust gas from the engine into the muffler;

first and second exhaust gas outlet tubes connected to the muffler for exhausting the exhaust gas from the muffler through at least one of the outlet tubes;

a valve assembly having a pivot shaft and a valve plate connected to the pivot shaft, the valve plate being situated in the second outlet tube and pivotally movable in the second outlet tube to control the exhaust-gas flow through the second outlet tube;

a pneumatic actuator having a reciprocating piston rod and a work chamber;

a pressure induction pipe connected to the muffler and the pneumatic actuator to feed the exhaust gas from the muffler to the work chamber, the pressure induction pipe having a tapered open end facing opposite an open end of the downstream portion of the inlet tube;

a link having one end secured to the pivot shaft and the other end secured to the piston rod so that reciprocating motion of the piston rod induces the valve plate to pivot and control the exhaust-gas flow through the second outlet tube, wherein the piston rod has a pin and the other end of the link has a longitudinally extending elongated opening, wherein the pin is slideably engaged with the opening to slideably secure the piston rod to the link, wherein the amount of piston rod reciprocation, thus the amount of valve plate opening in the second outlet tube, is controlled by pressure developed in the work chamber.

17. A muffler assembly for an exhaust system of an internal combustion engine, comprising:

a muffler;

an exhaust gas inlet tube having a downstream portion projecting into the muffler to feed the exhaust gas from the engine into the muffler;

first and second exhaust gas outlet tubes connected to the muffler for exhausting the exhaust gas from the muffler through at least one of the outlet tubes;

a valve assembly having a pivot shaft and a valve plate connected to the pivot shaft, the valve plate being situated in the second outlet tube and pivotally movable in the second outlet tube to control the exhaust-gas flow through the second outlet tube;

a pneumatic actuator having a reciprocating piston rod and a work chamber;

a pressure induction pipe connected to the inlet tube and the pneumatic actuator to feed the exhaust gas from the inlet tube to the work chamber, the pressure induction pipe having a tapered open end directed against the exhaust-gas flow in the inlet tube; and a link having one end secured to the pivot shaft and the other end secured to the piston rod so that reciprocating motion of the piston rod induces the valve plate to pivot and control the exhaust-gas flow through the second outlet tube, wherein the piston rod has a pin and the other end of the link has a longitudinally extending elongated opening, wherein the pin is slideably engaged to slideably secure the piston rod to the link, wherein the amount of piston rod reciprocation, thus the amount of valve plate opening in the second outlet tube, is controlled by pressure developed in the work chamber.

18. A muffler assembly for an exhaust system of an internal combustion engine, comprising:

a muffler;

an exhaust gas inlet tube having a downstream portion projecting into the muffler to feed the exhaust gas from the engine into the muffler;

first and second exhaust gas outlet tubes connected to the muffler for exhausting the exhaust gas from the muffler through at least one of the outlet tubes;

a valve assembly having a pivot shaft and a valve plate connected to the pivot shaft, the valve plate being situated in the second outlet tube and pivotally movable in the second outlet tube to control the exhaust-gas flow through the second outlet tube;

a pneumatic actuator having a reciprocating piston rod and a work chamber;

a pressure induction pipe connected to the muffler and the pneumatic actuator to feed the exhaust gas from the muffler to the work chamber, the pressure induction pipe having a tapered open end facing opposite an open end of the downstream portion of the inlet tube;

a first link having one end secured to the pivot shaft; and a second link having one end pivotally connected to the other end of the first link, wherein the piston rod has a fork-like end portion pivotally connected to the other end of the second link so that reciprocating motion of the piston rod induces the valve plate to pivot and control the exhaust-gas flow through the second outlet tube, wherein the amount of piston rod reciprocation, thus the amount of valve plate opening in the second outlet tube, is controlled by pressure developed in the work chamber.

19. A muffler assembly according to claim 18, further including a pivot pin through which the fork-link end portion and the other end of the second link are pivotally connected, and a holding pawl for holding the pivot pin in place.

20. A muffler assembly according to claim 17, further including an orifice member operatively installed in the pressure induction pipe to regulate pressure.

* * * * *